United States Patent [19]

Lackey et al.

[11] 4,118,083

[45] Oct. 3, 1978

[54] CABINET BASE CONSTRUCTION FOR ROOF TOP AIR CONDITIONER

[75] Inventors: Robert S. Lackey, Pittsburgh; Robert R. Young; John C. Kastovich, both of Murrysville, all of Pa.

[73] Assignee: Westinghouse Electric Corp., Pittsburgh, Pa.

[21] Appl. No.: 853,988

[22] Filed: Nov. 23, 1977

[51] Int. Cl.[2] ..... F25D 19/00; E04B 7/18

[52] U.S. Cl. ..... 312/100; 52/822; 62/DIG. 16; 62/259; 165/47; 165/67; 312/253; 248/346

[58] Field of Search ..... 62/DIG. 16, 259, 263; 165/47, 67; 312/284, 100, 253; 52/624; 248/346

[56] References Cited

U.S. PATENT DOCUMENTS

| | | | |
|---|---|---|---|
| 3,702,211 | 11/1972 | Young et al. | 312/257 SK |
| 3,721,106 | 3/1973 | Bierwirth et al. | 62/259 |
| 3,878,655 | 4/1975 | Toth et al. | 62/259 |
| 4,016,729 | 4/1977 | Cherry | 62/259 |

*Primary Examiner*—Mervin Stein
*Assistant Examiner*—Alex Grosz
*Attorney, Agent, or Firm*—E. C. Arenz

[57] ABSTRACT

The base construction comprises base rails along each side and each end, with each of the rails having the shape in transverse cross section of an upwardly open channel with the outer leg of the channel having a height greater than the inner leg, and the inner leg having a horizontal flange projecting inwardly from along the top of the inner leg, and separate pan means forming the bottom walls for both the outdoor air flow section and the separate indoor air flow section, each including a horizontal wall and an upturned flange along each edge, the pans nesting in the frame formed by the rails, the assembly thus formed being secured together by spot welding the upturned flanges to the outer legs, and the horizontal walls of the pans along their margins to the inwardly projecting horizontal flanges of the rails.

4 Claims, 6 Drawing Figures

CABINET BASE CONSTRUCTION FOR ROOF TOP AIR CONDITIONER

CROSS REFERENCE TO RELATED APPLICATION

Lackey, U.S. patent application Ser. No. 853,989, filed on Nov. 23, 1977 is a related application in the sense that the general construction of the roof top air conditioning unit including a part of the base construction is disclosed therein.

BACKGROUND OF THE INVENTION

1. Field of the Invention

The invention pertains to the art of roof top air conditioning units and specifically to cabinet base constructions therefor.

2. Description of the Prior Art

Roof top air conditioners mounted upon a flat roof are typically supported by what is called a curb which comprises a generally rectangular frame supported on and connected to the roof, and upon the upper edge of which the perimeter of the bottom of the roof top air conditioner rests. The curb may be of either the covered over type which includes a pan extending over at least a part of the curb, or of the open type in which the curb is basically only a perimeter structure. In either event, the curb and roof top unit may both require the use of stiffening and supporting structural members extending along the top of the curb structure or along the underside of the cabinet structure. Because of the importance of adequate support and other factors, frequently the roof curb is manufactured or at least specified in design by the roof top air conditioner manufacturer.

Besides considerations of providing a unit and curb which are complementary to each other with respect to strength, roof top cabinets should also be designed with sufficient structural strength to accommodate handling, warehouse stacking, shipment, and rigging of the unit to the roof top by crane or helicopter typically. At the same time, it is desirable that the cabinet be as light as is reasonably possible to reduce manufacturing handling and shipment costs. Also, it is desirable that the cabinet be adapted to accommodate a good weathertight seal between the cabinet and the roof curb.

U.S. patents which disclose to one degree or another structural arrangements for roof top air conditioners and curbs are U.S. Pat. No. 3,702,211, which discloses a curb straddle arrangement and U.S. Pat. No. 4,016,729. However, neither of these patents disclose arrangements which are considered to provide the benefits of an arrangement according to this invention.

SUMMARY OF THE INVENTION

The cabinet base construction according to the invention for an air conditioning unit of the roof top type and which has both an outdoor air flow section and a separate indoor air flow section comprises a rectangular frame of side and end base rails, each of the rails having a shape in transverse section which includes an upwardly open channel with the outer leg thereof at a height greater than the inner leg and with the inner leg having a horizontal flange projecting inwardly from along the top of the inner leg, and separate pan means from the bottom walls for the sections with each pan including a horizontal wall and an upturned flange along each edge, the pans together being dimensioned to nest in the perimetric area defined by the inner faces of the outer legs of the frame and with the upturned flanges along the outer edges abutting the upper marginal portion of the frame outer legs which project above the height of the top of the frame inner legs, and with the upturned flanges of the pan means which extend from side to side intermediate the ends of the frame being in abutting relation, the upturned flanges being spot-welded to the abutting members and the horizontal walls of said pans being spot-welded to the horizontal inturned flanges of the inner legs of the rails. With this arrangement, the base frame essentially has the strength of a box frame type of construction without requiring the use of heavy structural members, this construction also accommodating the passage of rainwater into the channels by simply providing holes in the horizontal wall of the pan of the outdoor air flow section immediately above the channels. Further, the arrangement permits the dimensions of the rectangular frame of the base to include a lengthwise dimension between the inner legs of the end rails slightly in excess of the length of a rectangular curb, and the dimension between the inner legs of the opposite side rails slightly in excess of the width of the curb so that with installation of the base of the cabinet upon a curb the channels lie outside the curb and below the level of the top face of the curb to provide an overlapping and overhanging weather seal.

DRAWING DESCRIPTION

DESCRIPTION OF THE PREFERRED EMBODIMENT

Figure 1:
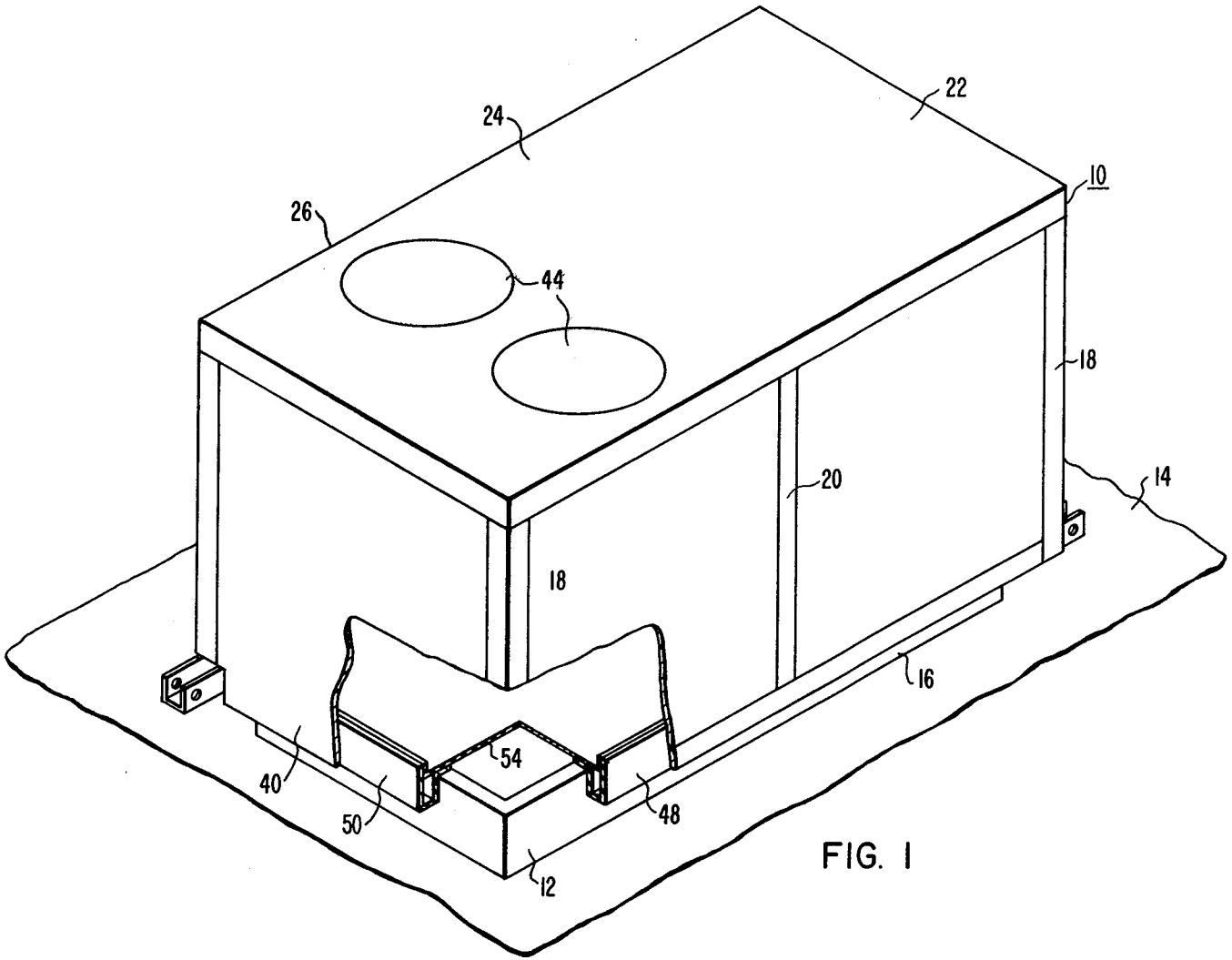
FIG. 1 is an isometric view of a roof top unit having the construction according to the invention seated upon a roof and curb.

In FIG. 1, the cabinet 10 of the air conditioning unit is shown resting upon curb 12, which in turn is supported by the roof 14. The cabinet of the unit is formed by the base section 16 to which is attached upright corner posts 18 at each corner, and intermediate side posts 20, the top 22 being connected to and supported by the upper ends of the uprights.

Figure 2:
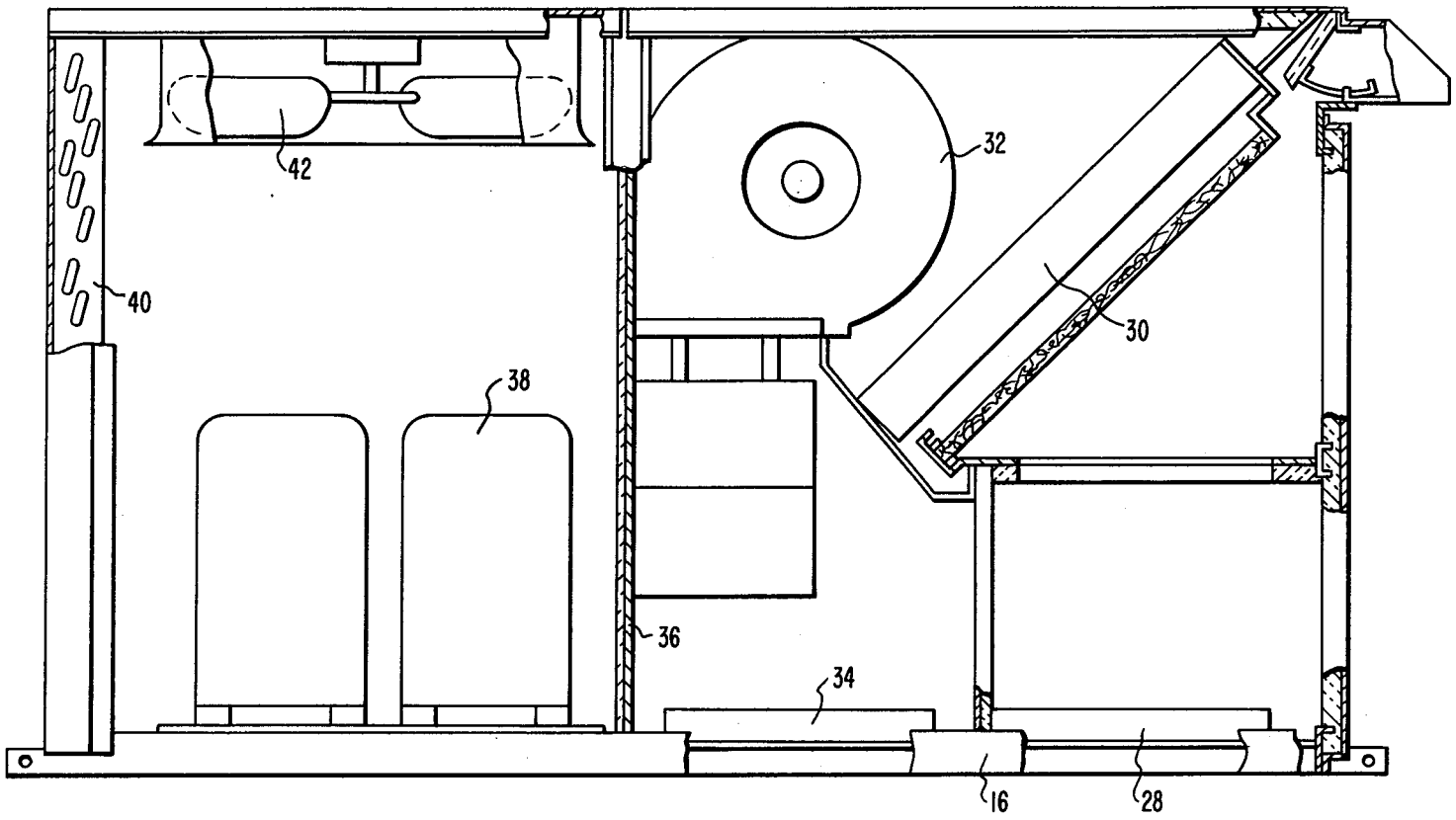
FIG. 2 is a partly broken side view of the roof top unit with the access panels omitted.

Referring to FIGS. 1 and 2, the cabinet is divided into an indoor air flow section 24 and an outdoor air flow section 26. The indoor air flow section as shown in FIG. 2 is arranged for a vertical air flow mode such as occurs when the roof top unit is installed upon a roof top with return air to the unit entering opening 28 in the base section 16 and being drawn through refrigerant coil 30 which operates as an evaporator in a cooling operation and as a refrigerant condenser in a heating operation, this air flow being created by centrifugal fans 32 which forces the air back down through the space underlying the fans and out of the discharge 34 back to the space served by the air conditioning unit.

The indoor air flow section and the outdoor air flow section are separated by the intermediate vertical partition 36, the outdoor air flow section containing the usual components such as compressors 38, condenser 40 occupying an end wall space (FIG. 1) of the cabinet, and condenser fans 42 which draw outdoor air through the condenser 40 and discharge this air upwardly through the openings 44 in the top wall 22. Further details as to the arrangement of parts within the cabinet are described in the noted Lackey patent application, to which reference should be had.

Figure 3:
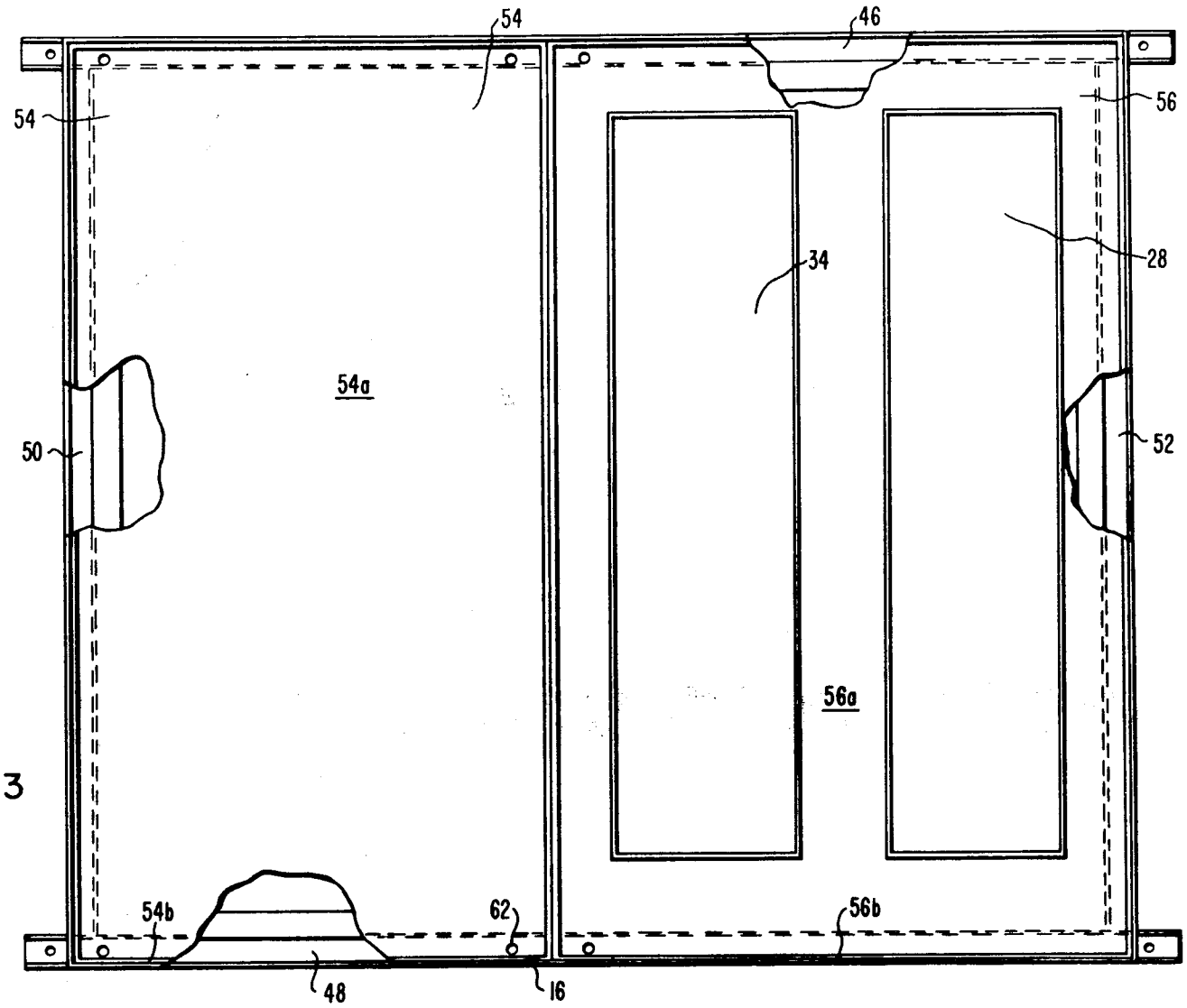
FIG. 3 is a partly broken plan view of the base of the cabinet.
Figure 4:
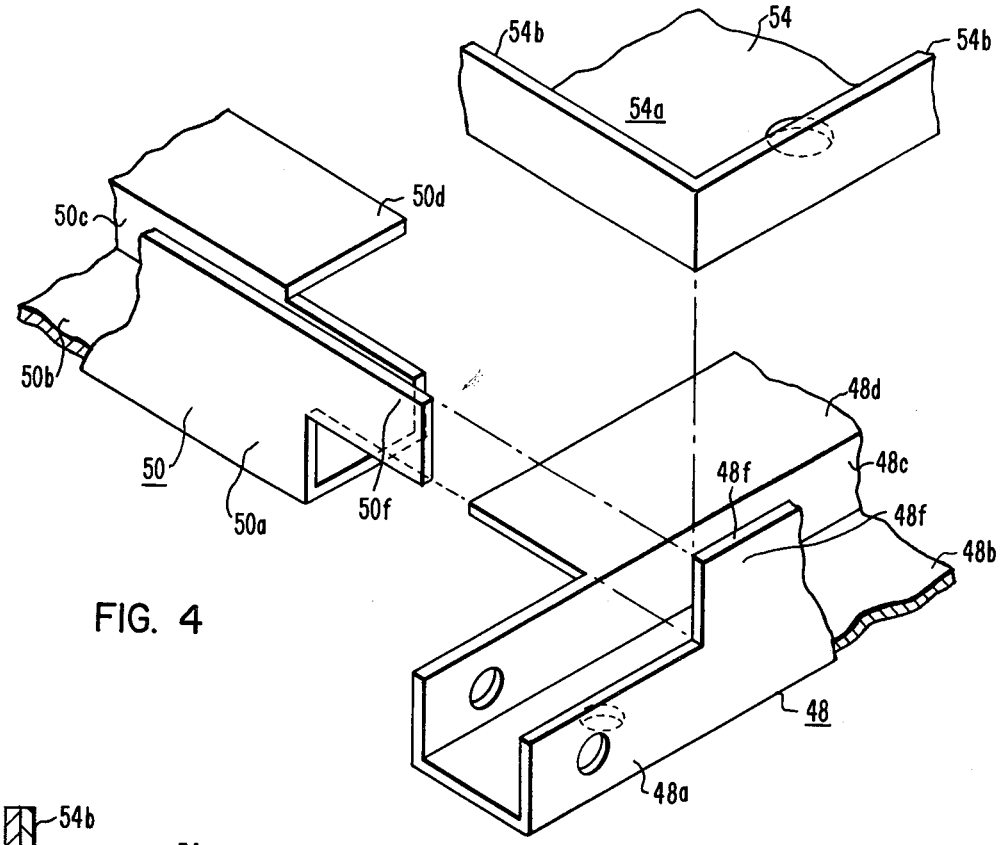
FIG. 4 is an exploded isometric view of a corner of the base construction.
Figure 6:
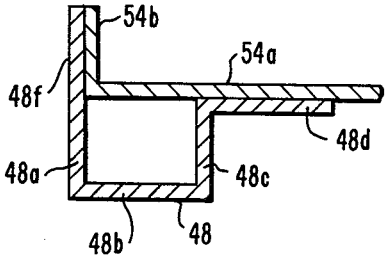
FIG. 6 is a vertical sectional view of a side base rail and pan margin.

Referring now to FIGS. 3 and 4, the base section 16 includes base rails 46 and 48 extending along each of the opposite sides, and base rails 50 and 52 extending along the opposite ends, all of these rails being arranged and secured together to form a substantially rectangular frame with the ends of the side base rails projecting beyond the ends of the cabinet as is apparent in FIG. 3. Since the shape in transverse cross section of each of the base rails is the same, only the side base rail 48 will be described in detail as to its shape as an example. The side base rail 48 (FIGS. 4 and 6) includes an upwardly open channel formed of an outer leg 48*a*, a web 48*b*, and an inner leg 48*c* which has a horizontal flange 48*d* projecting inwardly from along the top edge of the inner leg. The outer leg 48*a* has a height greater than that of the inner leg 48*c*, with the top marginal portion of the outer leg 48*a* in excess of the height of the inner leg 48*c* being designated 48*f*. In FIG. 4, the end base rail 50 has its comparable parts identified by corresponding adscripts.

As is best seen in FIG. 4, the ends of the side and base rails have parts cut to permit an interfitting arrangement to form the corner with fillet welds being applied to several of the intersections of the parts. As shown, the ends of the channels of the side rails are open, while the ends of the channels of the end rails are closed by the abutment against the inner legs of the side rails. In certain applications, such as where the air conditioning unit is of the type to be operated as a heat pump, in which case the coil 40 (FIG. 1) which normally operates as a condenser would operate as an evaporator, it may be desirable to provide an opening from the end rail 50 channel into channels of the side rails 46 and 48. This may be easily accomplished by removing a small lower part of the inner leg 48*c* at the location where the end channel abuts the inner leg.

Referring to FIGS. 3 and 4, to complete the base section two separate shallow pans 54 and 56 are provided, the pan 54 forming the bottom wall for the outdoor air flow section and the pan 56 forming the bottom wall for the indoor air flow section. Each pan includes a horizontal wall 54 and 56*a*, and an upturned flange 54*b* and 56*b* along each edge of each pan, the upturned flange having a height corresponding to the height of the marginal portions 48*f* and 50*f* of the outer legs of the base rails.

The pans are dimensioned so that in end-to-end relation they nest in the perimetric area defined between the inner faces of the outer legs of the base rails forming the rectangular frame, with the upturned flanges along the outer edges of the pans abutting the upper marginal portions of the frame outer legs and with the upturned flanges of the pans which extend from side to side intermediate the ends of the frame and separating the air flow sections 24 and 26 (FIG. 1) also being in abutting relation.

Figure 5:
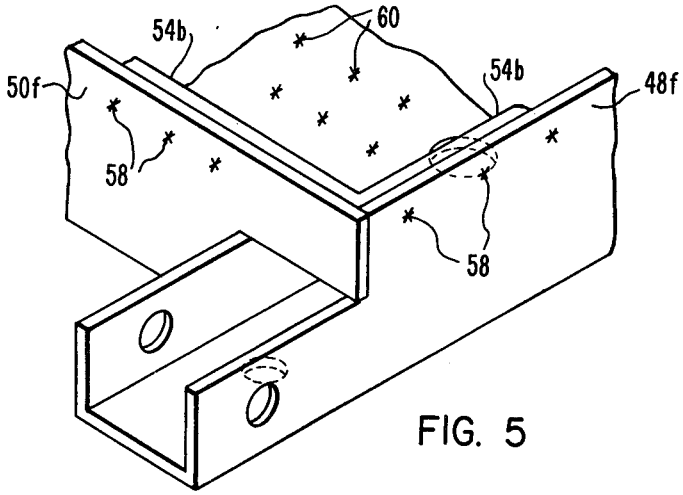
FIG. 5 is a fragmentary isometric view of a corner of the base construction illustrating an arrangement as assembled and indicating weld points.

The separate pans 54 and 56 (FIG. 3) are seated on the frame in the nested relation mentioned, and then, referring to FIG. 5, the pans are spot-welded to the frame at spaced locations along the abutting upturned flanges of the pan and the upper marginal portions of the base rails as indicated by the numeral 58 in FIG. 5, and the bottom walls of the pans are spot-welded as indicated by the numeral 60 to the inturned flanges of the inner legs of the base rails. Additionally, the abutting upturned flanges which extend from side to side of the base and separate the two air flow sections are also spot-welded at spaced locations. With the construction described, relatively lightweight sheet metal may be used in the base construction along with the spot welding at the strategic locations to give an adequately strong structural unit to withstand normal handling and rigging practices.

Referring to FIG. 3, an opening 62 is provided in the bottom wall 54*a* adjacent each of the corners of the pan 54 to overlie the upwardly open channels of the side base rails. These holes are provided to permit drainage from the outdoor air flow section of rainwater or other moisture which is able to penetrate the outdoor air flow section, so that the moisture can flow in the channels of the side base rails to the ends thereof and pass on to the roof. Such holes may also be provided in the bottom wall of the pan of the indoor air flow section to drain rain or snow leakage. Condensate from the evaporator coil is handled in a different manner and piped out through a trap. If the unit is to be used as a heat pump, in which case at times the refrigerant coil 40 may be utilized as an evaporator in a heating operation, then it may be desirable to provide additional openings in the bottom wall 54 of the outdoor air flow section immediately above the end rail channel 50 to accommodate defrost water, where permitted by code.

It is noted that the upturned flanges which meet and extend from side to side intermediate the sections form a barrier to the passage of water from one section to the other, as well as performing a stiffening function for the base construction as a whole.

While it will be apparent that if desired the roof curb may be dimensioned so that the webs of the base rails seat upon the top edge of the curb, the base construction described lends itself well to seating upon a roof curb which is dimensioned such that the inwardly directed flanges of the base rails seat upon the top edge of the curb, with the channels of the base rails being outwardly of the curb, as may be readily seen in the broken away corner of FIG. 1. In such an installation, it will be appreciated that the weight of the unit is not simply applied through a single thickness of bottom wall of a pan, but rather is applied to the frame and pan construction as a whole which has the box frame character of structural strength.

As may be seen in FIG. 2, the provision of the intermediate upturned flanges of the pans which serve as an unbroken barrier to the passage of water between the sections also permits a convenient arrangement of securing the bottom edge of the intermediate panel 36 to the upturned flanges by simply providing offset clips 62 along the lower edge of the panel 36 to provide a slip fit connection.

We claim:

1. A cabinet base construction for an air conditioning unit of the type adapted for a roof top or slab installation and having an outdoor air flow section and a separate indoor air flow section, comprising:

a substantially rectangular frame comprised of a base rail along each opposite side and along each opposite end, each base rail having a shape in transverse cross section including an upwardly open channel formed of an outer leg, a web, and an inner leg, the outer leg having a height greater than said inner leg, and the inner leg having a horizontal flange projecting inwardly from along the top of the inner leg;

separate pan means forming the bottom wall for the separate outdoor air flow section and indoor air flow section, each pan means including a horizontal wall and an upturned flange along each edge, the pan means together being dimensioned to nest in the perimetric area defined by the inner faces of said outer legs of the frame, with the upturned flanges along the outer edges of the pan means abutting that upper marginal portion of the frame outer legs projecting above the height of the top of the frame inner legs, and with the upturned flanges of said pan means which extend from side to side intermediate the ends of the frame being in abutting relation; and said upturned flanges being spot-welded to the abutting members and the horizontal wall of said pan means being spot-welded to said horizontal inturned flanges of said inner legs.

2. A cabinet base construction according to claim 1 wherein:

at least one of said base rails is open-ended at a corner of said frame; and said horizontal wall of said pan means includes openings therein overlying the upwardly open channel in said outdoor air flow section to pass rainwater falling into said outdoor air flow section into said channels and out an end.

3. A cabinet base construction according to claim 1 wherein:

said base rails at each opposite end of said frame are dimensioned to fit within the space between the opposite side rails, each end of said end rails being welded to said side rails at the locations of abutment.

4. A cabinet base construction according to claim 1 and adapted to seat upon a rectangular curb of a given length and width wherein:

the dimensions of the rectangular frame of the base include a lengthwise dimension between the inner legs of the end rails slightly in excess of the length of the rectangular curb, and the dimension between the inner legs of the opposite side rails is slightly in excess of the width of the curb, so that upon installation of the base upn a curb the channels lie outside the curb and below the level of the top face of the curb.

* * * * *